US008602254B2

(12) United States Patent
Ki

(10) Patent No.: US 8,602,254 B2
(45) Date of Patent: Dec. 10, 2013

(54) SWIVEL COMPACT CONTAINER

(75) Inventor: Joong-Hyun Ki, Incheon (KR)

(73) Assignee: Yonwoo Co Ltd., Incheon (KR)

( * ) Notice: Subject to any disclaimer, the term of this patent is extended or adjusted under 35 U.S.C. 154(b) by 0 days.

(21) Appl. No.: 13/255,497

(22) PCT Filed: Feb. 17, 2010

(86) PCT No.: PCT/KR2010/000978

§ 371 (c)(1),
(2), (4) Date: Sep. 8, 2011

(87) PCT Pub. No.: WO2010/104271

PCT Pub. Date: Sep. 16, 2010

(65) Prior Publication Data

US 2012/0000926 A1 Jan. 5, 2012

(30) Foreign Application Priority Data

Mar. 10, 2009 (KR) ..... 10-2009-0020497

(51) Int. Cl.
*B65D 51/18* (2006.01)

(52) U.S. Cl.
CPC ..... *B65D 51/18* (2013.01)
USPC ..... 220/826; 206/581

(58) Field of Classification Search
CPC ..... B65D 2251/1083
USPC ..... 220/826, 810, 822, 820, 254.6, 254.3, 220/254.4, 254.1; 206/581, 223, 216; 132/296, 295, 304, 301
IPC ..... B65D 51/04,51/18
See application file for complete search history.

(56) References Cited

U.S. PATENT DOCUMENTS

| | | | | |
|---|---|---|---|---|
| 1,518,594 | A | 12/1924 | Marble | |
| 5,437,294 | A | 8/1995 | Ebbets, III et al. | |
| 2005/0194021 | A1 * | 9/2005 | Byun | 132/295 |
| 2008/0000493 | A1 * | 1/2008 | Anderson et al. | 132/295 |
| 2008/0023023 | A1 | 1/2008 | Boye et al. | |
| 2008/0295857 | A1 * | 12/2008 | Gatesoupe | 132/295 |
| 2008/0302384 | A1 * | 12/2008 | Parker | 132/294 |

FOREIGN PATENT DOCUMENTS

KR 20-0404308 Y1 12/2005

* cited by examiner

*Primary Examiner* — Jacob K Ackun
*Assistant Examiner* — Robert J Hicks

(57) ABSTRACT

A swivel compact container has an upper casing and a lower casing hinged with each other. The upper side of the lower casing is opened or closed by a rotation of the upper casing. The swivel compact container further includes a compact fixture which is installed in the interior of the lower casing, has a rotation protrusion that protrudes from both sides of the compact fixture and is installed in the interior of the lower casing, and rotates in an upward direction about the rotation protrusion, and a compact storing casing which is installed at one side of the compact fixture, is rotatable by 360°, and includes a plurality of compact storing grooves at its upper and lower sides to store stuff therein.

3 Claims, 3 Drawing Sheets

SWIVEL COMPACT CONTAINER

TECHNICAL FIELD

The present invention relates to a swivel compact container, and in particular to a swivel compact container which is easy to use since a storing casing can store stuff at its upper and lower compartments and is rotatable.

BACKGROUND ART

Compact is a kind of cosmetics which makes it possible to make a skin look smooth and beautiful before a color makeup following a basic makeup. The cosmetics container like a compact has a powder puff casing in its interior. A mirror is attached at an inner side of an upper lid. When in use, a user opens a lid and lifts up a casing with a compact and takes out a powder puff stored in a powder puff casing, and engages a dish in a container body, and applies a compact to a powder puff, thus putting on a makeup.

The conventional compact contact, however, is inconvenient to use since a user is needed to lift up a disk in order to use a powder puff since a powder puff is stored below a disk in which a compact is stored.

DISCLOSURE OF INVENTION

Accordingly, the present invention is basically directed to overcoming the above-described problems encountered in the conventional art. It is an object of the present invention to provide a swivel compact container which is easy to use since a storing casing can store stuff at its upper and lower compartments and is rotatable.

To achieve the above object, there is provided a swivel compact container which has an upper casing and a lower casing hinged with each other wherein an upper side of the lower casing is open or closed by means of a rotation of the upper casing, which container comprises a compact fixture which is installed in the interior of the lower casing, with a rotation protrusion being protruded from both sides of the compact fixture, respectively, and is installed in the interior of the lower casing and rotates in an upward direction about the rotation protrusions; and a compact storing casing which is installed at one side of the compact fixture and is rotatable at 360° and includes a plurality of compact storing grooves at its upper and lower sides for thereby storing stuff therein, respectively.

The compact storing casing includes a brush storing groove for storing a brush, and a brush fixing part is protruded from an inner side of the brush storing groove for thereby fixing a bush.

The upper casing includes a mirror installation groove which is formed in the interior of the same for thereby installing a mirror M.

ADVANTAGEOUS EFFECTS

In the present invention, it is appreciated that the compact is easy to use since a storing casing can store stuff at its upper and lower compartments and is rotatable.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

Figure 1:
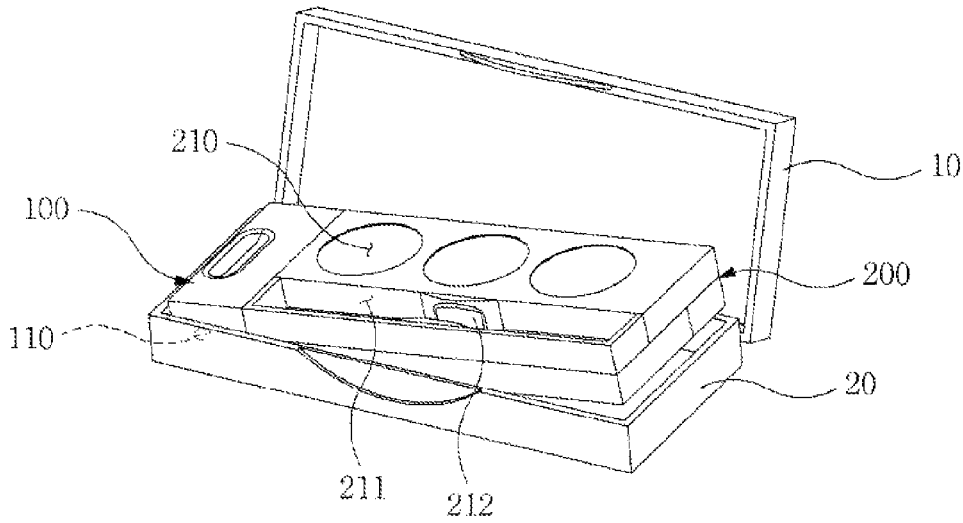
FIG. 1 is a perspective view illustrating a swivel compact container according to a preferred embodiment of the present invention.

The preferred embodiments of the present invention will be described with reference to the accompanying drawings. The same reference numerals in each drawing mean the same elements in the present invention.

Figure 2:
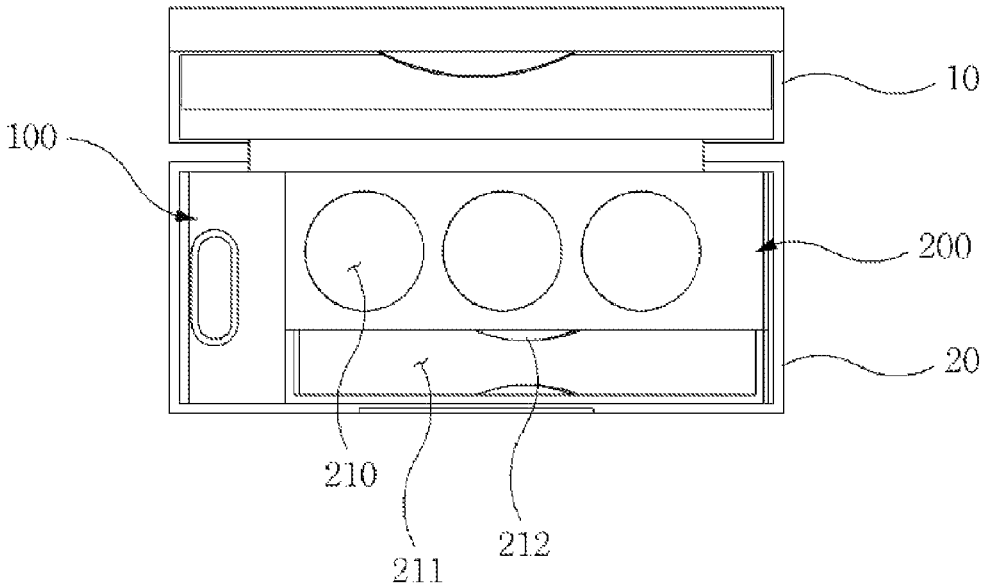
FIG. 2 is a plane view illustrating a swivel compact container according to a preferred embodiment of the present invention.

FIG. 1 is a perspective view illustrating a swivel compact container according to a preferred embodiment of the present invention, and FIG. 2 is a plane view illustrating a swivel compact container according to a preferred embodiment of the present invention.

As shown in FIGS. 1 and 2, it is appreciated that the swivel compact container according to a preferred embodiment of the present invention comprises a compact fixture 100 and a compact storing casing 200 and might further comprise a brush storing groove 211 and a brush fixing part 212.

An upper casing 10 and a lower casing 20 are hinged by a hinge. As the upper casing 10 rotates the upper part of the lower casing 20 is open or closed. It is appreciated that a user uses compact by opening the upper casing 10. In the interior of the lower casing is installed a compact fixture 100 and a compact storing casing 200, thus storing compact.

The compact fixture 100 is installed in the interior of the lower casing 20 and rotates in an upward direction. The compact fixture 100 is constituted in such a way that a rotation protrusion 110 is protruded from both sides of the same, respectively. The rotation protrusions 110 are installed at the side surface in the interior of the lower casing 20. The compact fixture 100 is therefore fixed in the interior of the lower casing 20 and rotates in the upward direction at the same time along with the compact storing casing 20.

Figure 3:
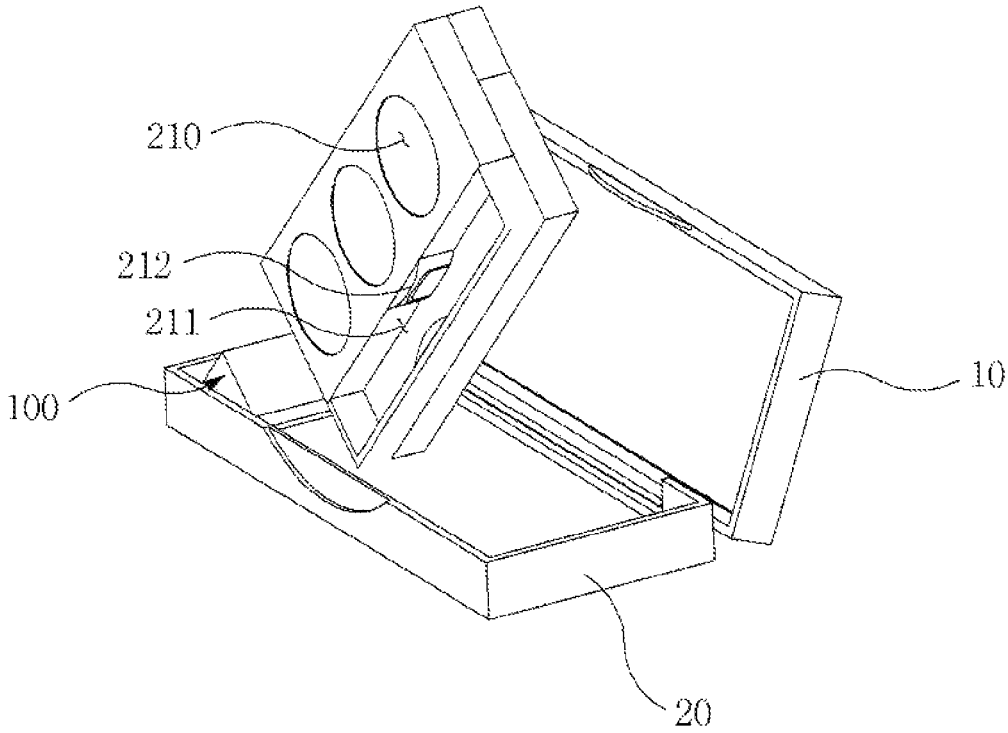
FIG. 3 is a view of a use state of a swivel compact container according to a preferred embodiment of the present invention.

The compact storing casing 200 is installed at one side of the compact fixture 100, and a plurality of compact storing grooves 210 are formed at the upper and lower sides of the same, thus storing compact therein. In the inner upper and lower sides of the compact storing groove 210 might be stored compact as well as diverse cosmetics, and the inner space might be portioned in different shapes and sizes depending on a user's choice. As shown in FIG. 3, the compact storing casing 200 is constituted to rotate in an upward direction at the same time along with the compact fixture 100 and then rotates at 360°. Since a user can rotate the compact storing casing 200, all the compact stored at the upper and lower sides of the compact storing casing 200 can be used, which is a major advantage of the present invention.

Figure 4:
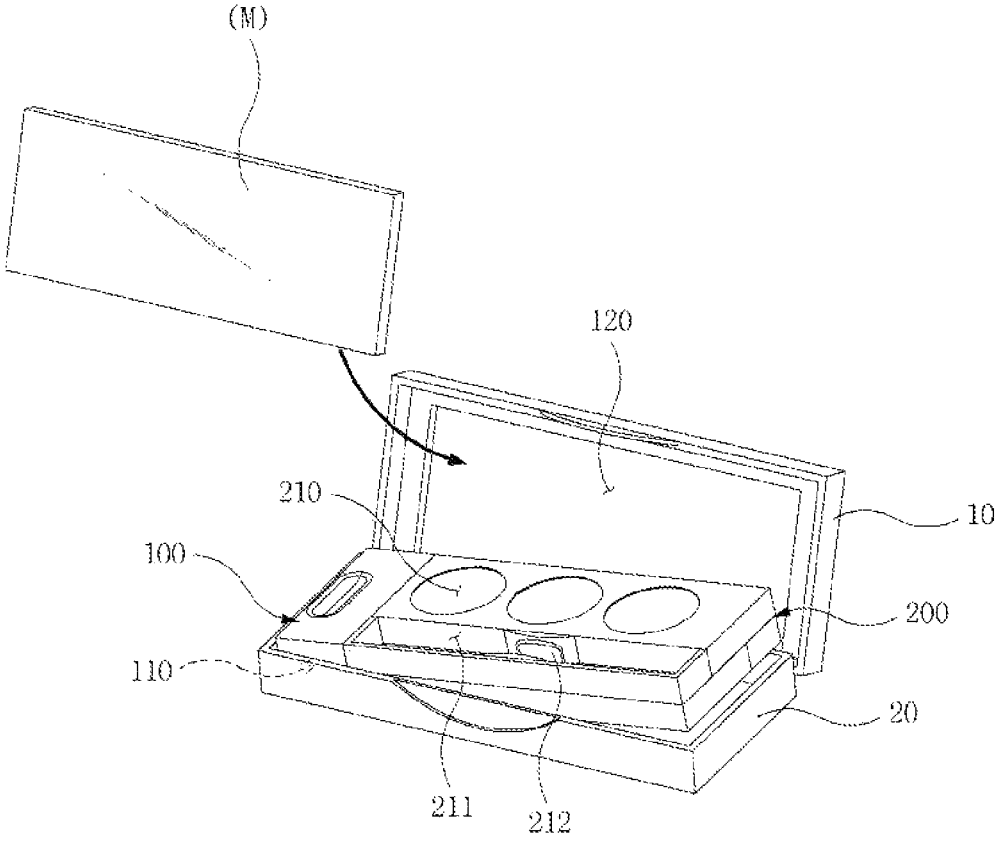
FIG. 4 is a perspective view illustrating a swivel compact container according to another embodiment of the present invention.

The swivel compact container according to another embodiment of the present invention will be described with reference to FIG. 4.

First, a brush storing groove 211 is formed at the compact storing casing 200 for storing brush. A brush fixing part 212 is formed at the brush storing groove 211. Here, the brush fixing part 212 is protruded from an inner side of the brush storing groove 211. With the above construction, even when a user rotates the compact storing casing 200, the brush is prevented from an escape from the brush storing groove 211.

In addition, a mirror installation groove 120 for installing a mirror M is formed in the interior of the upper casing 10, thus helping a user put on a makeup. The mirror installation groove 120 has the same surface area as the mirror M, so it is preferred that an edge of a mirror M is tightly inserted into the interior of the upper casing 10.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A swivel compact container which has an upper casing and a lower casing hinged with each other, wherein an upper side of the lower casing is open or closed by rotation of the upper casing, the swivel compact container comprising:

a compact fixture which is installed in an interior of the lower casing, the compact fixture having a rotation protrusion that protrudes from both sides of the compact fixture, respectively, and the compact fixture rotating in an upward direction about the rotation protrusions; and a compact storing casing which is installed at only one cross-section surface of the compact fixture, is rotatable by 360°, and includes a plurality of compact storing grooves at its upper and lower sides for thereby storing stuff therein, respectively.

2. The container of claim 1, wherein said compact storing casing includes a brush storing groove for storing a brush, and wherein a brush fixing part is protruded from an inner side surface of the brush storing groove.

3. The container of claim 1, wherein said upper casing includes a mirror installation groove which is formed in an interior of the same for thereby installing a mirror (M).

* * * * *